US005169058A

United States Patent [19]

Sample

[11] Patent Number: 5,169,058

[45] Date of Patent: Dec. 8, 1992

[54] PIZZA TOTE

[76] Inventor: Leola Sample, 585 E. 16th St., Apt. G-5, Brooklyn, N.Y. 11226

[21] Appl. No.: 872,685

[22] Filed: Apr. 20, 1992

[51] Int. Cl.[5] ..... B65D 5/46

[52] U.S. Cl. ..... 229/117.23; 229/117.18; 229/117.19; 229/158

[58] Field of Search ..... 229/117.18, 117.19, 229/117.23, DIG. 6, 915, 117.14, 155, 158; 294/152, 156; 224/250

[56] References Cited

U.S. PATENT DOCUMENTS

| | | | |
|---|---|---|---|
| 1,693,420 | 11/1928 | Wilson | 229/117.19 |
| 1,763,072 | 6/1930 | Smith | 229/117.14 |
| 2,177,993 | 10/1939 | Olsen | 229/117.19 |
| 2,181,482 | 11/1939 | Greve | 229/117.18 |
| 2,675,162 | 4/1954 | Higham | 229/117.23 |
| 2,680,556 | 6/1954 | Currie | 229/117.78 |
| 3,942,636 | 3/1976 | Matsuyama et al. | 294/156 |
| 4,318,505 | 3/1982 | Cordell, Jr. | 229/DIG. 6 |
| 4,732,316 | 3/1988 | Oliff et al. | 229/117.18 |
| 4,881,684 | 11/1989 | Chimman | 294/152 |
| 4,895,295 | 1/1990 | Montgomery et al. | 294/156 |

FOREIGN PATENT DOCUMENTS

| | | | |
|---|---|---|---|
| 74929 | 11/1952 | Denmark | 229/117.19 |
| 272972 | 9/1951 | Switzerland | 229/117.23 |
| 869651 | 6/1961 | United Kingdom | 294/152 |

*Primary Examiner*—Stephen Marcus
*Assistant Examiner*—Christopher J. McDonald
*Attorney, Agent, or Firm*—Richard L. Miller

[57] ABSTRACT

A pizza tote is provided for a foldable pizza box being of a one piece construction and having a top panel, a bottom panel, a central panel, with the top panel and the bottom panel each having three side panels. The pizza tote consists of a pair of elongated straps, each extending from one opposite side panel of the bottom panel. A mechanism is for joining the distal ends of the straps together to form a triangular configuration. A handle carrying assembly extends up from the apex of the triangular configuration of the straps, so that a person can grip with one hand the handle carrying assembly to carry the pizza box suspended therefrom.

6 Claims, 1 Drawing Sheet

PIZZA TOTE

BACKGROUND OF THE INVENTION

The instant invention relates generally to pizza boxes and more specifically it relates to a pizza tote.

Numerous pizza boxes have been provided in the prior art that are adapted to package and maintain the temperature of pizzas in an optimal state, as during delivery or the like. For example, U.S. Pat. Nos. 4,441,626 to Hall; 4,806,736 to Schirico and Des. 292,176 to Kuerti all are illustrative of such prior art. While these units may be suitable for the particular purpose to which they address, they would not be as suitable for the purpose of the present invention as hereafter described.

SUMMARY OF THE INVENTION

A primary object of the present invention is to provide a pizza tote that will overcome the shortcomings of the prior art devices.

Another object is to provide a pizza tote in which elongated straps are formed out of the cardboard structure of a pizza box, whereby a handle carry assembly can be attached thereto so that it can be carried with one hand.

An additional object is to provide a pizza tote whereby the elongated straps form a triangular configuration, so that vertical arms can extend therefrom to engage with an attachable handle, which are all fabricated out of the cardboard material of the pizza box.

A further object is to provide a pizza tote that is simple and easy to use.

A still further object is to provide a pizza tote that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 1:
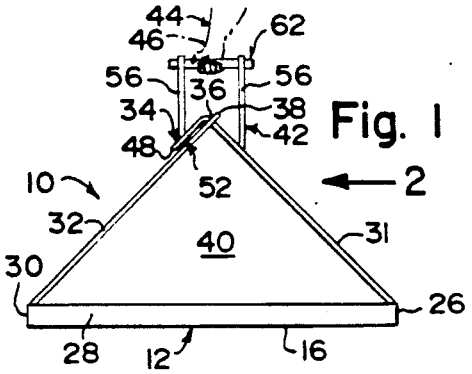
FIG. 1 is a diagrammatic front view of the instant invention assembled and ready for use.
Figure 2:
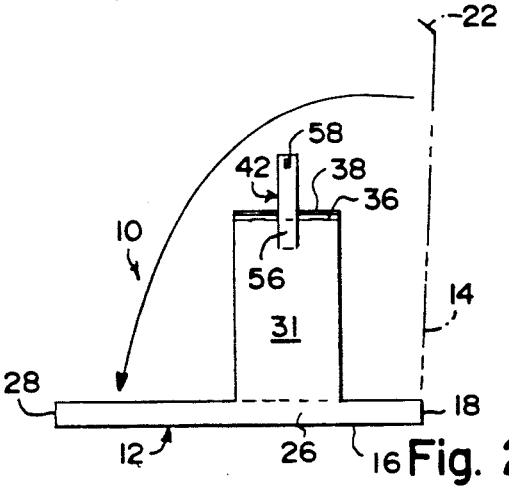
FIG. 2 is a side view of the instant invention as indicated by arrow 2 in FIG. 1.
Figure 4:
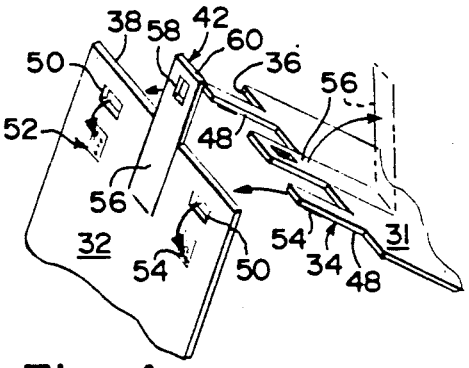
FIG. 4 is an enlarged partial perspective view of the strap joining mechanism.
Figure 4A:
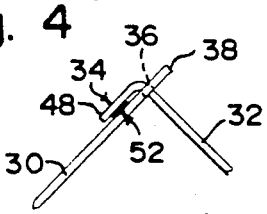
Figure 3:
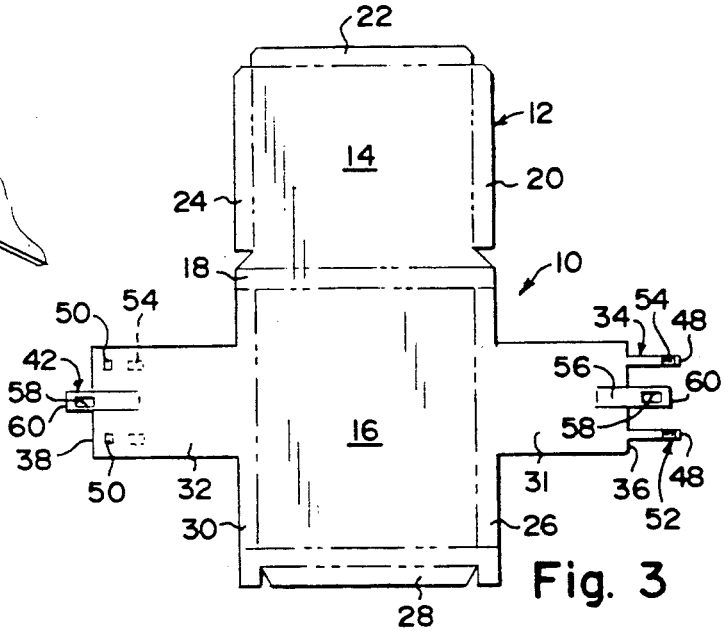
FIG. 3 is a flat plan view of the instant invention illustrating the pattern before folding.
Figure 5:
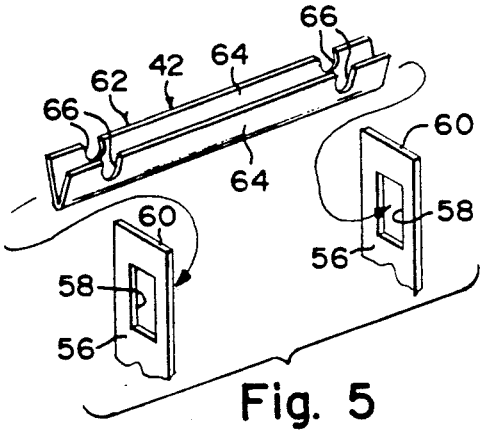
Figure 6:
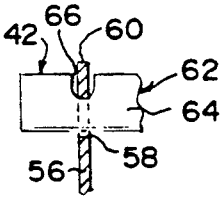
Figure 7:
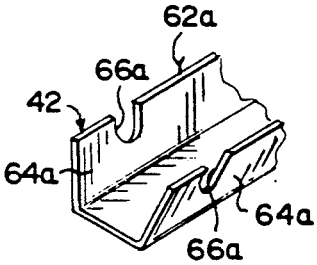

FIG. 4*a* is an enlarged front view of the strap joining mechanism after the straps have been secured together;

FIG. 5 is a partial exploded perspective view of the handle carrying assembly;

FIG. 6 is an enlarged front view with parts broken away of the handle carrying assembly; and FIG. 7 is an enlarged fragmentary perspective view of a second embodiment of the handle per se.

DETAILED DESCRIPTION OF THE PREFERRED EMBODIMENTS

Turning now descriptively to the drawings, in which similar reference characters denote similar elements throughout the several views, the Figures illustrate a pizza tote 10 for a foldable pizza box 12, being of a one piece construction and having a top panel 14, a bottom panel 16, a central panel 18, with the top panel 14 and the bottom panel 16 each having three sides panels 20, 22, 24, 26, 28 and 30. The pizza tote 10 consists of a pair of elongated straps 31 and 32, each extending from one opposite side panel 26 and 30 of the bottom panel 16. A mechanism 34 is for joining the distal ends 36 and 38 of the straps 30 and 32 together to form a triangular configuration 40. A handle carrying assembly 42 extends up from the apex of the triangular configuration 40 of the straps 30 and 32, so that a person 44 can grip with one hand 46 the handle carrying assembly 42 to carry the pizza box 12 suspended therefrom.

The joining mechanism 34 includes the first strap 31 having a pair of spaced apart foldable flaps 48 extending from the distal end 36 thereof. The second strap 32 has a pair of spaced apart apertures 50 near the distal end 38 thereof, so that the flaps 48 can extend through the apertures 50 and be folded down.

A mechanism 52 is for securing both of the flaps 48 to the second strap 32 when folded down. The securing mechanism 52 is a pair of mating hook and loop pile fabric fasteners 54.

The handle carrying assembly 42 includes a pair of side arms 56, each extending upwardly from one of the straps 31 and 32 and has an aperture 58 near the top end 60 thereof. A handle 62 extends through the apertures 58 near the top ends 60 of the side arms 56 so that a person 44 can grip the handle 62 with one hand 46 to carry the pizza box 12 suspended therefrom.

The handle 62 is a folded piece of cardboard that is V-shaped in cross section for added strength. Each upright leg 64 of the handle 62 has a pair of spaced apart U-shaped notches 66 that are aligned, so that said U-shaped notches 66 can engage with the top portions of the aperture 58 in the side arms 56.

FIG. 7 shows an alternate construction for the handle 62*a* as a folded piece of cardboard that is U-shaped in cross section for added strength. Each upright leg 64*a* of the handle 62*a* has a pair of spaced apart U-shaped notches 66*a* that are aligned, so that the U-shaped notches 66*a* can engage with the top portions of the apertures 58 in said side arms 56.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pizza tote for a foldable pizza box being of a one piece construction and having a top panel, a bottom panel, a central panel with the top panel and the bottom panel each having three side panels, said pizza tote comprising:

a) an elongated first strap and an elongated second strap each having a distal edge, each extending from an opposite side panel of the bottom panel;

b) means for joining the distal ends of said first strap and said second strap together to form a triangular configuration; and c) a handle carrying assembly extending up from the apex of the triangular configuration of said straps, so that a person can grip with one hand said handle carrying assembly to carry the pizza box suspended therefrom.

2. A pizza tote as recited in claim 1, wherein said joining means includes:

a) said first strap having a pair of spaced apart foldable flaps extending from the distal end thereof;

b) said second strap having a pair of spaced apart apertures near the distal end thereof, so that said flaps can extend through said apertures and be folded down; and c) means for securing both of said flaps to said second strap when folded down.

3. A pizza tote as recited in claim 2, wherein said securing means is a pair of mating hook and loop pile fabric fasteners.

4. A pizza tote as recited in claim 3, wherein said handle carrying assembly includes:

a) a pair of side arms, each extending upwardly from one said strap and having an aperture near the top end thereof; and b) a handle which extend through the apertures near the top ends of said side arms, so that a person can grip said handle with one hand to carry the pizza box suspended therefrom.

5. A pizza tote as recited in claim 4, wherein said handle is a folded piece of cardboard that is V-shaped in cross section for added strength, with each upright leg of said handle having a pair of spaced apart U-shaped notches that are aligned, so that said U-shaped notches can engage with the top portions of the apertures in said side arms.

6. A pizza tote as recited in claim 4, wherein said handle is a folded piece of cardboard that is U-shaped in cross section for added strength, with each upright leg of said handle having a pair of spaced apart U-shaped notches that are aligned, so that said U-shaped notches can engage with the top portions of the apertures in said side arms.

* * * * *